US005203248A

United States Patent [19]

Carr et al.

[11] Patent Number: 5,203,248

[45] Date of Patent: Apr. 20, 1993

[54] PORTABLE PAGE TURNER FOR MUSIC SHEETS

[76] Inventors: Douglas J. Carr, 24226 Ambassador Pl., Harbor City, Calif. 90710; Lincoln Lucero, 2333 W. 246th Pl., Lomita, Calif. 90717

[21] Appl. No.: 841,061

[22] Filed: Feb. 25, 1992

[51] Int. Cl.[5] ..... G10G 7/00
[52] U.S. Cl. ..... 84/487
[58] Field of Search ..... 84/487, 490, 492

[56] References Cited

U.S. PATENT DOCUMENTS 2,484,106 10/1949 Mallina ..... 84/487
3,665,093 5/1972 Machnacz ..... 84/487

*Primary Examiner*—Michael L. Gellner
*Assistant Examiner*—P. J. Stanzione
*Attorney, Agent, or Firm*—Frank McKenzie

[57] ABSTRACT

A page turning device for turning over the pages of a music score, periodicals etc. The device uses a battery powered, reversible electric motor. Several torpedo tabs ride on an endless belt to turn the pages. Forward and backward page turning is accomplished, as well as multiple page turning. The device further includes a foot actuated, programmable mode of operation.

6 Claims, 3 Drawing Sheets

PORTABLE PAGE TURNER FOR MUSIC SHEETS

FIELD OF THE INVENTION

The present invention relates to a portable page turning device particularly for use in turning the pages of a music score, periodicals etc.

DESCRIPTION OF THE PRIOR ART

Numerous page turning devices have been suggested in the past. For example, U.S. Pat. No. 3,665,093 issued to Machnacz shows a page turning device which is mounted on a rectangular board. U.S. Pat. No. 2,484,106 issued to Mallina shows a mechanical page turner. Neither of the above referenced devices, considered either singly or in combination, is seen to suggest the instant invention as claimed.

SUMMARY OF THE INVENTION

Accordingly, one object of the present invention is to provide a page turner for sheet music and the like that can be operated by one's foot since it requires the use of both hands to play most musical instruments.

Another object of this invention is to provide a page turner which is portable and may easily be attached to any music stand.

Still another object of this invention is to provide a page turning device in which the pages will not get jammed.

A final object of this invention is to provide a page turning device which is can accomplish forward or backward multiple page turning.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
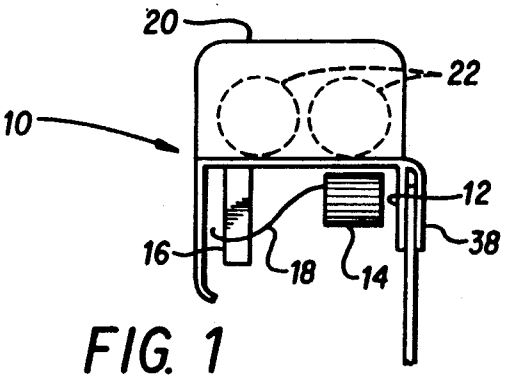
FIG. 1 is a side view of the page turning device.

FIG. 1 shows a side view of the page turning device. The device, generally designated as 10 includes an L-shaped chassis 12, the upper portion of which supports a small reversible electric motor with a drive post 14 and an idler post 16. Entrained around the drive post 14 and the idler post 16 is an endless belt 18. The endless belt may be string or other materials. The electric motor is protected by a cover 20.

Figure 2:
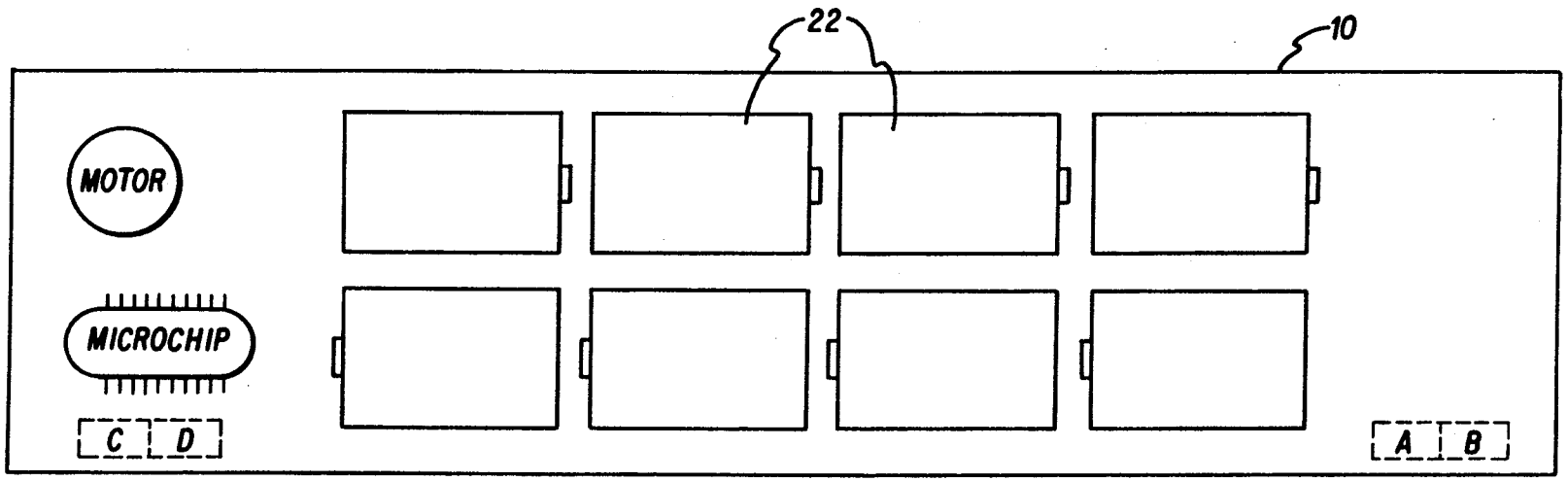
FIG. 2 is a top view of the chassis of the device with the cover removed.

In FIG. 2, it can be seen that the motor is powered by a series of batteries 22. Also in FIG. 2, it can be seen that on the underside of the chassis 12 are mounted 4 gates, 2 on the right side of the chassis. These gates are used to control the movement of the torpedo tabs, as will be explained later.

Figure 3A:
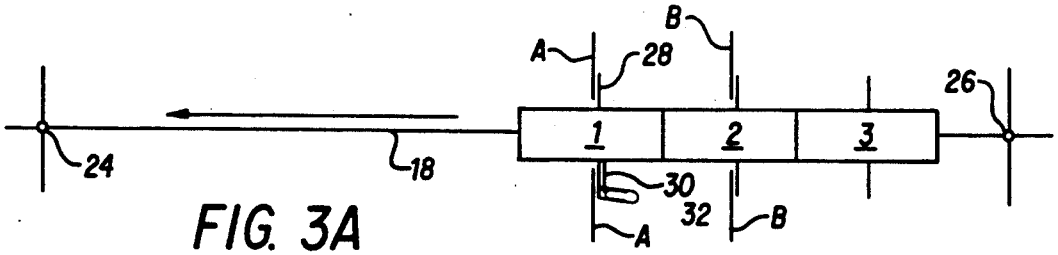
FIG. 3A-3H are diagrams showing the operation of the device.
Figure 4:
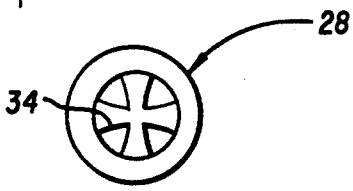
FIG. 4 is an end view of one of the torpedo tabs of the device.

Referring now to FIG. 3A, a plurality of torpedo tabs 1,2 and 3 are shown mounted on the drive belt 18. Each torpedo tab includes a circular fin 28, a leash 30 and clip 32 for attachment to a page. One torpedo tab must be provided for each page to be turned. As shown in FIG. 4, each torpedo tab has an inner circular opening with flexible fingers 34 which make frictional engagement with endless belt 18.

Figure 3B:
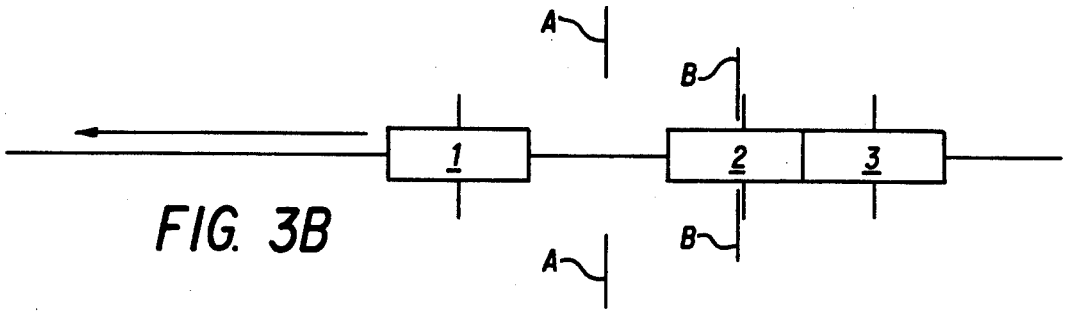
Figure 3C:
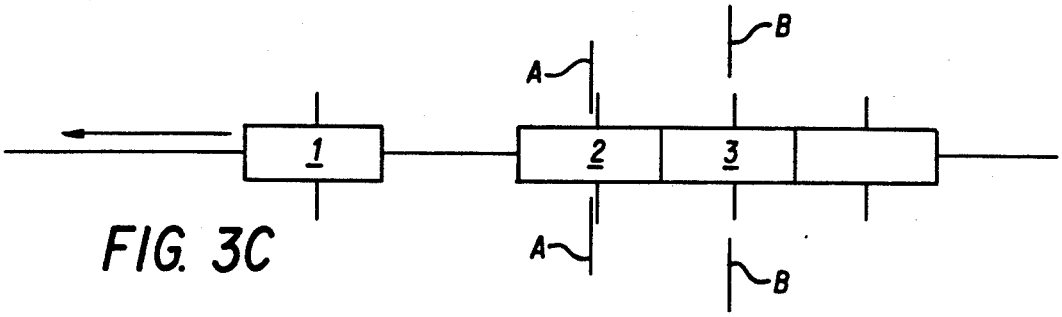
Figure 3D:
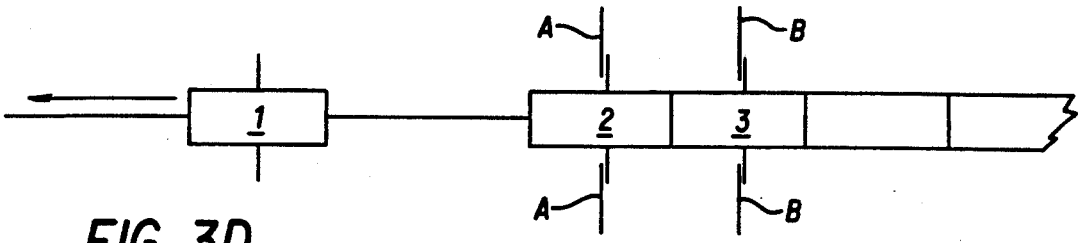
Figure 3E:
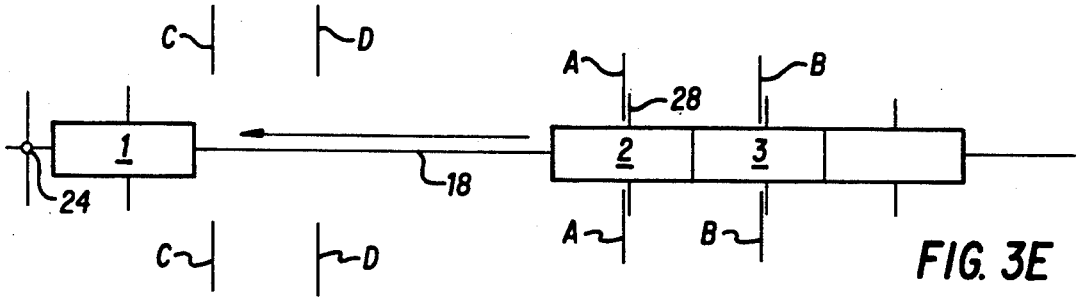
Figure 3F:
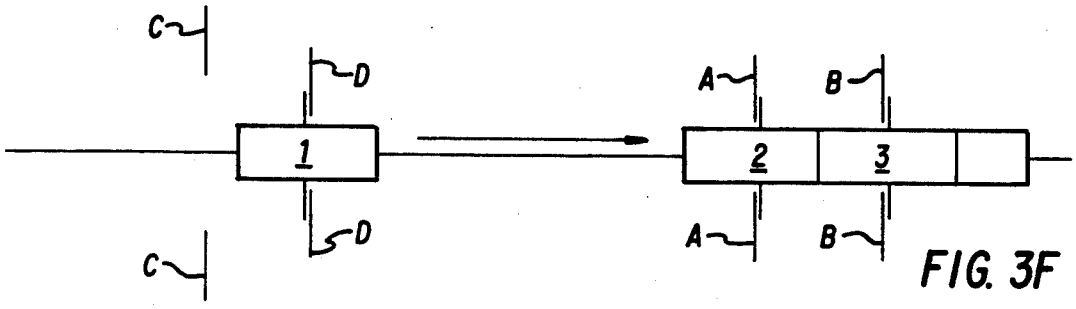
Figure 3G:
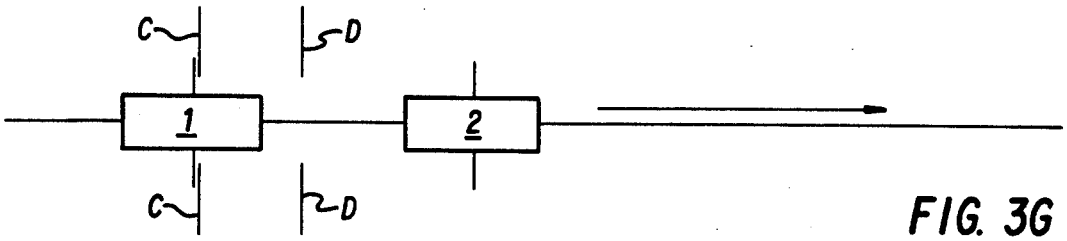
Figure 3H:
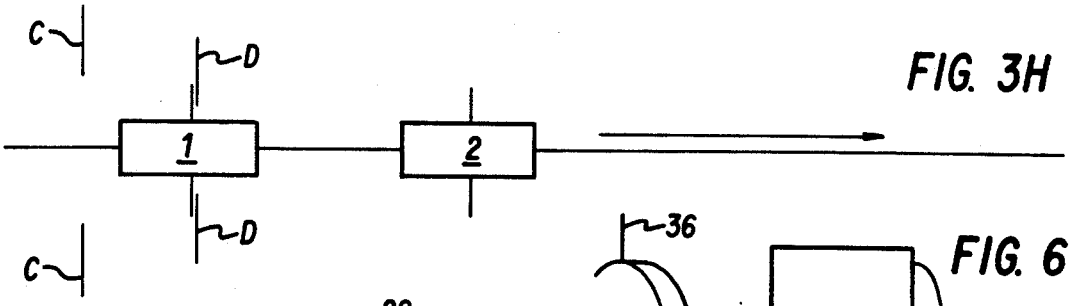

The operation of the device is illustrated in FIGS. 3A-3H. FIG. 3A shows 3 torpedo tabs 1,2 and 3 mounted in a starting position on endless belt 18 between a left stop 24 and a right stop 26. As shown in FIG. 3E, the device includes two gates C and D on the left hand side of chassis 12 and two gates A and B on the right hand side of the chassis. When the electric motor is actuated, gate A opens and allows the fin 28 of torpedo tab 1 to move to the left as shown in FIG. 3B. Torpedo tab 2 remains behind closed gate B. In FIG. 3C, gate A is closed, but gate B is open to allow torpedo tab 2 to move to the left. Torpedo tab 1 will continue to move to the left until it reaches left stop 24. At this point one page has been turned and gates C and D are open. (See FIG. 3E) If it is desired to turn a second page, gate A must be opened again to allow torpedo tab 2 to move further to the left. When it is desired to turn the pages backwards, gates C and D must be opened and closed in a manner similar to the gates A and B described previously. (See FIGS. 3F and 3G).

Figure 5:
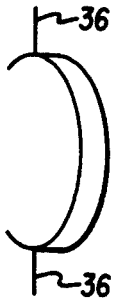
FIG. 5 is a side view of one of the gates of the device.

Whenever a torpedo tab reaches one of the stops 24 or 26 or is held against movement by one of the gates, the endless belt is allowed to slide through the torpedo tabs due to the flexibility of the fingers 34. Each of the gates A,B,C and D has two pins 36 as shown in FIG. 5. The pins move in and out simultaneously to an opened or closed position.

Figure 6:
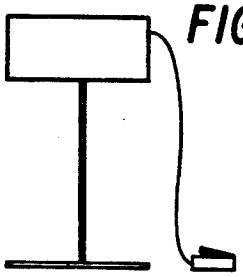
FIG. 6 is a view of the actuator of the device and a typical music stand.

The reversible motor enables the device to turn pages backward and forward. The device may include a foot operated actuating means as shown in FIG. 6. Also, a micro chip may be installed and programmed for multiple page turning.

The page turning device also includes a spring clip 38 as shown in FIG. 1 to facilitate easy attachment or removal from a typical music stand as shown in FIG. 6.

We claim:

1. A page turning device for turning the pages of a music score, said device comprising:

An L-shaped chassis which supports a drive train which includes an electric motor, a power source, an. endless belt, a drive post, an idler post, a left stop, a right stop, a plurality of torpedo tabs mounted on said endless belt between said left and right stops said torpedo tabs having an opening which is in frictional engagement with said endless belt, said motor being reversible to drive said torpedo tabs in either a left or right direction between said left and right stops, a leash attached to each of said torpedo tabs, each of said leashes including a clip for attachment to a music page, two gates mounted on a left side of said chassis for controlling the movement of said torpedo tabs in a first direction, two gates mounted on a right side of said chassis for controlling the movement of said torpedo tabs in a second direction, a programmable means controlling the opening and closing of all said gates, and actuator means for causing said programmable means to open and close of said gates to allow backward or forward movement of one or more of said pages.

2. The page turning device of claim 1 wherein said chassis includes a clip for attachment of said device to a music stand.

3. The device of claim 1 wherein said opening in said torpedo tab includes a plurality of flexible fingers for frictional engagement with said endless belt.

4. The device of claim 1 wherein said actuating means is foot operated.

5. The device of claim 1 wherein said actuating means is by a programmed micro-chip to accomplish multiple page turning.

6. The device of claim 1 which includes a spring clip for attachment to a music stand.

* * * * *